US005799428A

United States Patent [19]

Poindexter

[11] Patent Number: 5,799,428

[45] Date of Patent: Sep. 1, 1998

[54] SIGN DISPLAY ATTACHMENT

[75] Inventor: Gary S. Poindexter, Kansas City, Mo.

[73] Assignee: Kansas City Poster Display Company, Kansas City, Mo.

[21] Appl. No.: 640,673

[22] Filed: May 1, 1996

[51] Int. Cl.[6] ..... G09F 3/20

[52] U.S. Cl. ..... 40/658; 40/611; 40/617; 40/652; 40/660; 248/215; 248/475.1

[58] Field of Search ..... 40/606, 611, 617, 40/652, 658, 660, 666; 248/475.1, 215; 24/341

[56] References Cited

U.S. PATENT DOCUMENTS

| | | | |
|---|---|---|---|
| 187,061 | 2/1877 | Snow | 40/658 |
| 534,799 | 2/1895 | Koehler | 40/666 |
| 1,258,941 | 3/1918 | Pease | 40/666 |
| 1,269,867 | 6/1918 | Shuman | 40/658 |
| 1,417,325 | 5/1922 | Hopp et al. | 40/658 |
| 1,572,994 | 2/1926 | Garfinkle | 40/658 |
| 1,668,059 | 5/1928 | Egan | 40/658 X |
| 1,838,786 | 12/1931 | Pollinger | 40/658 |
| 2,020,780 | 11/1935 | Hamilton | 40/652 X |
| 2,470,811 | 5/1949 | Engelman | 40/658 |
| 3,969,838 | 7/1976 | Moore . | |
| 4,494,658 | 1/1985 | Simon et al. . | |
| 4,677,780 | 7/1987 | Shuman . | |
| 4,798,013 | 1/1989 | Sainato . | |
| 4,899,474 | 2/1990 | Piana et al. | 40/658 X |
| 5,284,259 | 2/1994 | Conway et al. . | |
| 5,375,803 | 12/1994 | Kump . | |
| 5,400,992 | 3/1995 | Pohl . | |

FOREIGN PATENT DOCUMENTS

| | | | |
|---|---|---|---|
| 110772 | 5/1944 | Switzerland | 40/652 |

*Primary Examiner*—Kenneth J. Dorner
*Assistant Examiner*—Andrea Chop
*Attorney, Agent, or Firm*—Wm. Bruce Day

[57] ABSTRACT

A sign display device consists of a substantially U-shaped bracket with arms that resiliently grip a bar member such as used to form a frame for mounting a poster or sign. Slots extend through the bracket and are sized to receive sign clips that are affixed to the back of a sign. Use of the sign display device permits attaching a secondary sign to a main sign or poster display, with the bracket concealed by the secondary sign and standing out from the surface of the main sign for increased or enhanced visual recognition.

1 Claim, 3 Drawing Sheets

Fig. 5
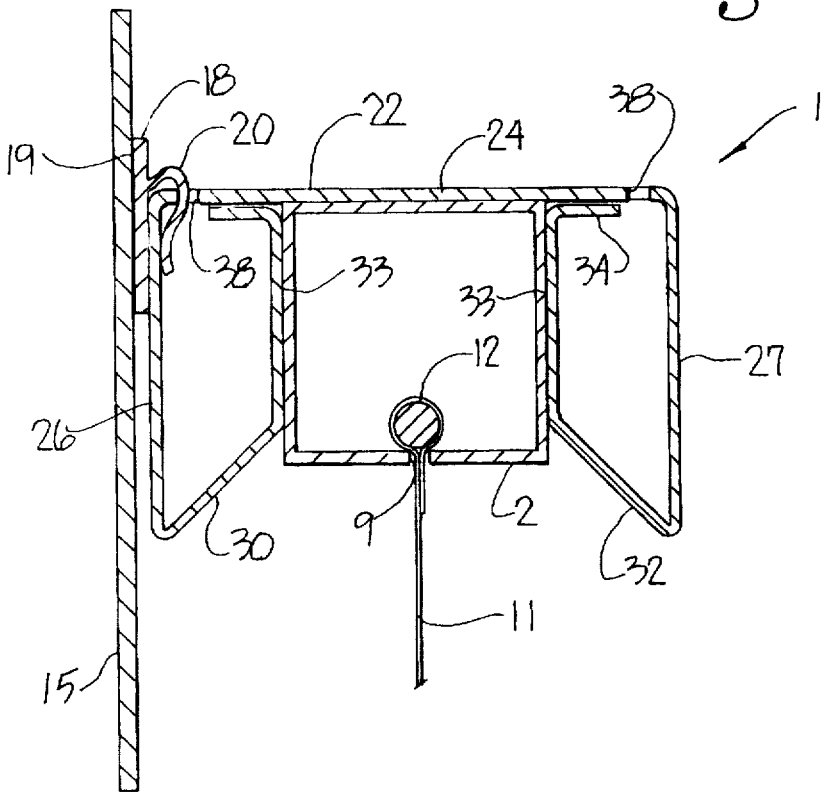
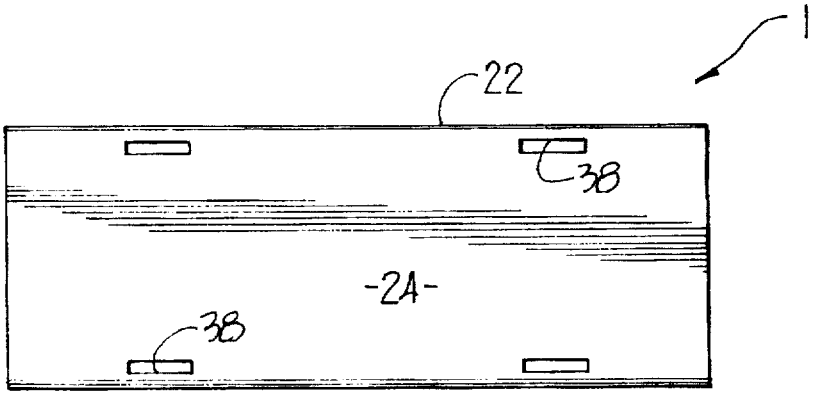
Fig. 6

SIGN DISPLAY ATTACHMENT

FIELD OF THE INVENTION

This invention relates to attachments or devices for displaying signs and which are attached to racks or other display frames.

BACKGROUND OF THE INVENTION

Frames for displaying posters and other signs may be either freestanding or attached to larger structures. The display fixtures are commonly rectangular or square extrusions which are used in elongate sections to hold the sign or poster to be displayed. While some displays, notably banners, are attached to the display frame by rope or cord lacing, more commonly the display sign has a thickened or beaded top edge which is received in a C-shaped channel bar forming the top bar of the perimeter frame. Often, both the frame top and bottom bars are C-shaped channels and receive the top and bottom edges of the sign or poster. A typical arrangement of such a display is shown in FIG. 1. Mounting clips, such as shown in FIG. 2, have long been used to glue onto the backs of posters or signs and then to clip the displayed sign to other signs.

When used in connection with clothing display racks, as mentioned in U.S. Pat. No. 5,400,992, signage mounted on display racks are often connected to cumbersome clamping systems which involve magnets, screws and telescoping C-clamp style clamps. The clamp in the '992 patent provides an alternative for such display racks.

BRIEF SUMMARY OF THE INVENTION

A signage display device is formed of an elongate bracket having a top web and spaced legs to form a U-shaped arrangement to straddle a display bar. The legs have inwardly extending spring arms which grip the opposite sides of the display bar. Slots through the top web adjacent the web edge and the legs receive sign clips for attaching a sign to the display bar. Preferably, the sign is a secondary sign and covers the bracket so that the signage display device presents a secondary sign smaller than the main sign and which stands out from its surface so as to provide increased visual recognition to the message imprinted on the secondary sign.

An object of the present invention is to provide a concealable display device which fastens removably yet securely to the perimeter frame of a main sign display rack. Another object is to provide such a signage display device which can be affixed to either horizontal or vertical perimeter frame members. Another object and advantage of the present invention is to create a signage display device which is simple and inexpensive to produce. Other objects and advantages of this invention will become readily apparent upon review of the following disclosure.

BRIEF DESCRIPTION OF THE DRAWINGS

FIG. 5 is a cross-sectional view taken along lines 5—5, FIG. 1.

FIG. 6 is a plan view of the sign display device.

DETAILED SPECIFICATION

Figure 1:
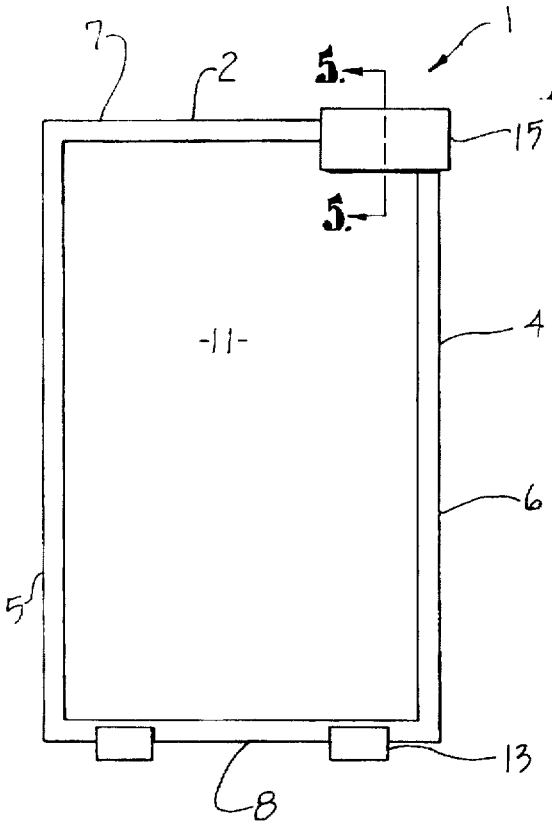
FIG. 1 is an elevational view of a main sign display holding a sign or poster and a secondary sign display embodying the present invention and shown providing a secondary message.

As required, details of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference 1, FIG. 1, refers to a signage display device comprising the present invention. The signage display device 1 is detachably mounted on a display bar member 2 which, in the example shown in FIG. 1, comprises a part of a sign display frame 4. The sign display frame 4 and bar member 2 are, of course, old and are not a part of this invention. The sign display frame 4, in the form shown in FIG. 1, is rectangular and is formed of a plurality of bar members 2 including opposite upright members 5 and 6 and top and bottom members 7 and 8. The members 5, 6, 7 and 8 are generally of transverse square section with at least the top member 7 being a C-shaped channel, FIG. 5. The top member 7 has a longitudinal slot 9 which forms a connector means to attach a sign or poster 11. The sign or poster 11 has a top or roll portion 12 which is trapped within the slot 9. Other methods of attachment, such as cord or rope lacing, can be appropriately used. The sign display frame 4 may be mounted against the wall or may be freestanding, having floor engaging legs 13.

Such a frame may display signs in retail establishments, theaters, sporting events and in numerous locales for advertisement or notices to the public. While the sign display frame 4 presents a main sign or poster 11, secondary sign 15 is mounted by the signage display device 1. Such a secondary sign may announce "opening soon", "sale", "available now" or other appropriate message subsidiary to the main message. In other situations, the signage display device 1 may present a main message sign. In summary, the signage display device 1 attaches to a frame member of some sort and holds a sign.

Figure 2:
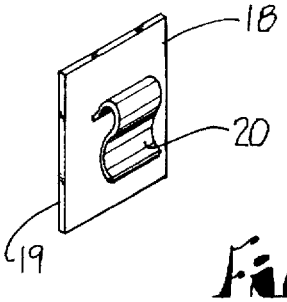
FIG. 2 is a perspective view of a sign clip.
Figure 3:
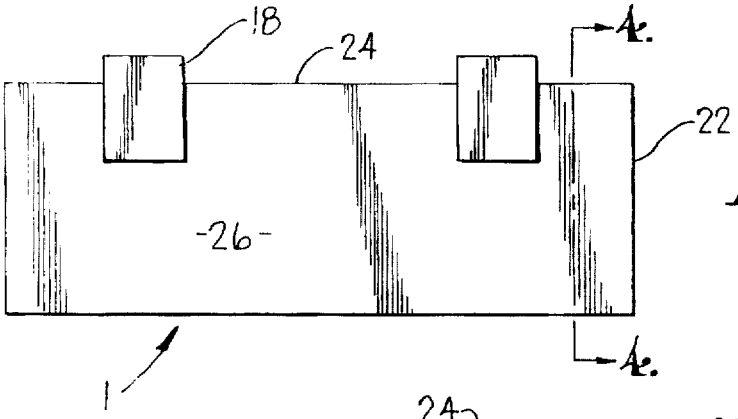
FIG. 3 is a side elevational view of the signage display device comprising the present invention.
Figure 4:
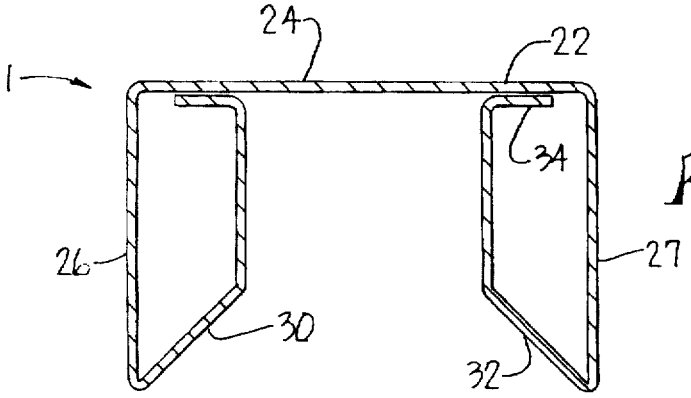
FIG. 4 is a cross-sectional view of the sign display device.

A sample of a sign clip 18 is shown in connection with FIG. 2. Sign clip 18 has flat plate 19 which is glued to a sign and a resilient clip 20 for clipping onto another sign or for as disclosed herein for mounting to the signage display device 1.

The signage display device 1 is formed of an elongate bracket 22 which may be formed of a folded sheet material, such as poster board or plastic or formed by extruding suitable plastic or metal. The bracket 22 has a top web 24 of which is sufficiently wider than the display bar member 2 to which the bracket 22 is to be attached. The top web 24 is joined by spaced, opposite legs 26 and 27 to form a U-shaped arrangement, an inverted U-shaped arrangement in the orientation shown in FIG. 5. The U-shaped arrangement, consisting of the top web 24 and legs 26 and 27, straddles the display bar member 2. The bracket 22 has spring means extending between the legs 26 and 27 and the nearest surface of the display bar member 2. Various forms of spring or tensioning members may be used to exert a pinching force in order to connect the bracket 22 to the bar member 2. In the illustrated example, the spring means are formed of a bentover resilient arm 30 extending inwardly and toward the display bar member 2. The resilient arm 30 is formed of a first upwardly angled arm portion 32, a second flat arm portion 33 paralleling the side of the display bar member 2 and a third arm portion 34 returning outwardly toward the respective leg 26 or 27. The resilient arm 30 acts to squeeze or clamp about the display bar member 2. Other forms of spring means may be used as appropriate.

A plurality of slots 38 extend through the top web 24 adjacent the respective side legs 26 and 27 and generally located toward the four corners of the bracket 22, FIG. 6. The clips 20 of the sign clip 18 extend through the slots 38, FIG. 5, to attach the secondary sign 15 to the bracket 22.

By use of the sign display device 1, a secondary sign 15 is held spatially distant or displaced from the sign or poster 11. This enables increased or enhanced visual perception of the secondary sign 15 and allows the message to stand out. Additionally, the secondary sign 15 is preferably mounted on the sign clips 18 so as to conceal the bracket 22. This presents a nice, finished appearance for the sign assembly.

Figure 7:
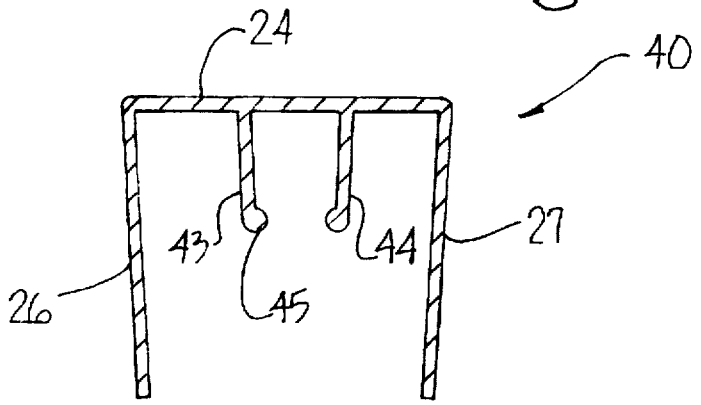
FIG. 7 is a cross-sectional view of an alternative form of the sign display device.
Figure 8:
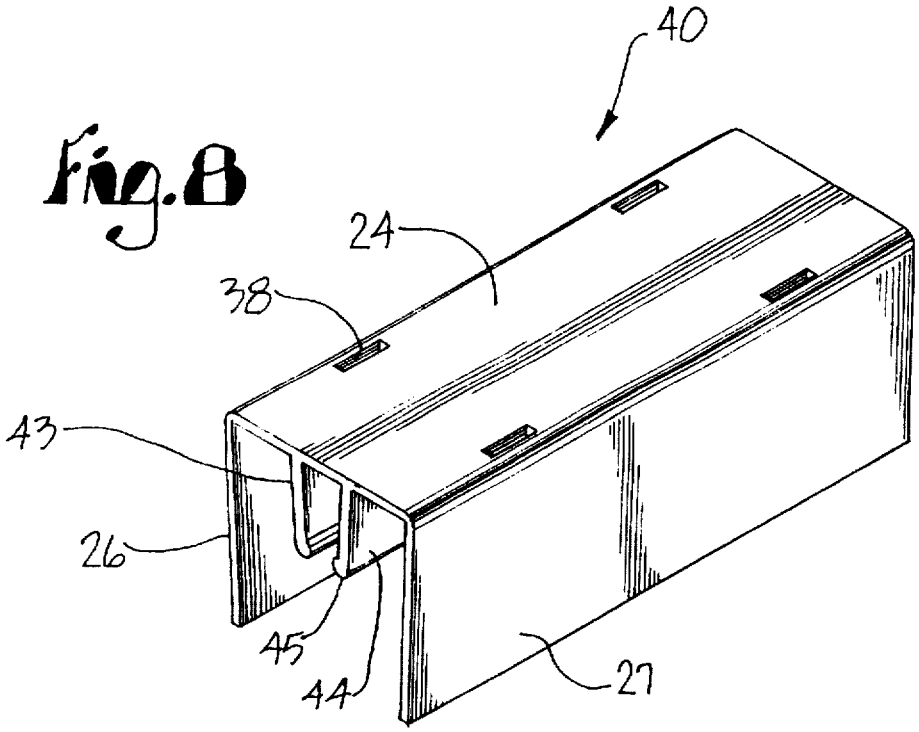
FIG. 8 is a perspective view of the alternative form of the sign display device.

An alternative form of the sign display device is shown in connection with FIGS. 7 and 8 and, which is believed to be the preferred embodiment of the invention. The alternative form is designated as sign display device 40 and is formed by a die extruded plastic or even metal material. The preferred material of construction is a suitable plastic. In outward form, the sign display device 40 is substantially identical to the sign display device 1, having a top web 24, respective side legs 26 and 27, and top slots 38. In distinction, the sign display device 40 has opposed gripping legs 43 and 44 which converge or angle in slightly from their juncture with the top web 24. The convergence is preferably only a few degrees, or an amount sufficient to provide a spring means, or resilient grip of the legs 43 and 44 about the display top member 7. Knob or rounded ends 45 on the gripping legs 43 and 44 facilitate slide-on, slide-off without scratching the finish of the top member 7.

Preferably, the gripping legs 43 and 44 are sized to be only slightly longer than the wall height of the display top member 7 so that the knob or rounded ends 45 snap over the lowermost edge of the top member 7 in a secure grip.

Various measurements of the sign display device 40 may be changed as necessary to adapt to display members 7 of differing dimensions. Use of the sign display device 40 is the same as the use of the sign display device 1.

It is to be understood that while certain forms of the invention have been illustrated and described herein, it is not to be limited to the specific forms or arrangement of parts described as shown except as set forth in the following claims.

What is claimed and desired to be secured by Letters Patent is as follows:

1. A signage display device comprising an elongate bracket formed of a top web and spaced outer legs to form a U-shaped arrangement to straddle a display bar member, the bracket having spring means formed of opposing inner legs depending from said top web and inwardly biased to resiliently grip a display bar member and removably affix said bracket thereto, said bracket having slots through said web adjacent said outer legs to receive sign clips for attaching a secondary sign to said display bar member so as to conceal said bracket.

* * * * *